US005400443A

United States Patent [19]

Marino

[11] Patent Number: 5,400,443

[45] Date of Patent: Mar. 28, 1995

[54] WASTE PROCESSING TOILET

[76] Inventor: John Marino, 6070 Languedoc, Montreal, Quebec, Canada, H1M 3C9

[21] Appl. No.: 130,188

[22] Filed: Oct. 1, 1993

[51] Int. Cl.[6] ..... E03D 1/00; A47K 11/02

[52] U.S. Cl. ..... 4/300; 4/111.5; 4/DIG. 12; 435/312; 422/209

[58] Field of Search ..... 4/300, 319, 320, 449, 4/111.1, 111.2, 111.3, 111.4, 111.5, 111.6, 459, DIG. 12, DIG. 17, DIG. 19; 435/312; 422/209, 210; 210/151

[56] References Cited

U.S. PATENT DOCUMENTS 4,051,561 10/1977 Frankel et al. ..... 4/111.3
4,087,869 5/1978 Billsund ..... 4/449 X
4,254,515 3/1981 Kiyama et al. ..... 4/449
5,171,690 12/1992 Ylosjoki ..... 435/312

*Primary Examiner*—Robert M. Fetsuga
*Attorney, Agent, or Firm*—Robic

[57] ABSTRACT

A modified flush toilet adapted to process solid human waste into a recyclable product. The toilet has a bowl with a chamber under it for receiving the waste flushed thereinto. A rotatable filter disk is mounted in the chamber. This filter disk allows the liquid waste to pass through and retains the solid waste. An electric heater is provided to convert from time to time the solid waste accumulated onto the disk into dry granules which may be blown into a bag and subsequently used as a fertilizer. A heavy duty disposal unit may also be incorporated into the toilet to treat other bathroom and household waste. The unit communicates with the chamber through a pipe.

14 Claims, 4 Drawing Sheets

WASTE PROCESSING TOILET

BACKGROUND OF THE INVENTION a) Field of the Invention

The present invention relates generally to waste transformation devices, more particularly to a toilet and disposal unit which significantly reduces human waste pollution and produces a recyclable material.

b) Brief Description of the Prior Art

The specific area of human waste treatment has not changed very much over an extended period of time. Solid and liquid wastes in a toilet are flushed, along with water, into sewage systems leading to treatment plants or rivers, lakes and seas in urban areas and septic tanks in rural areas. Other items such as various house and bathroom biodegradable wastes are disposed of in regular garbage collection. The recycling of such waste is therefore impossible. Moreover the large-scale processing of such non-recycled waste, especially solid waste, is very costly, requiring large filtration plants.

OBJECT AND SUMMARY OF THE INVENTION

The object of the present invention is to provide an apparatus which effectively transforms solid human waste and other bio-material into a product having a granular texture making it useful as a fertilizer.

More particularly the invention as broadly claimed hereinafter, lies in a modified flush toilet of block-like structure, designed to replace a standard toilet utility and be installed over the drain-pipe of the same. The structure comprises a generally L-shape box casing having a lower portion projecting frontwardly and a vertical portion extending above the front portion and integrally formed therewith.

The front portion comprises an uppermost standard toilet bowl having a seat slightly above the top surface of the front portion. The toilet bowl has a rear elbow-pipe, which, instead of communicating directly with the drainpipe, empties into a waste accumulation chamber disposed under the toilet bowl. The chamber is circular in shape and has a lower portion connected to the above mentioned drain pipe by a connection means.

The front portion of the unit also comprises:

a filter disk rotatably mounted the accumulation chamber;

first power means to rotate the disk;

second power means to move the disk from a first upper position to a second lower position for a purpose explained below; and heating means in tile accumulation chamber, which may include means to distribute the heat evenly in the accumulation chamber;

The vertical portion of the unit comprises the following parts:

a standard water tank connected to the toilet bowl in the conventional manner and also connected to a water supply that is of the building or house in which the unit is installed;

a supply pipe connected to the above-mentioned water supply, such pipe preferably having a shut-off valve;

a compartment preferably located at the upper area of the vertical portion of the casing, the compartment being accessible by a door;

a bag disposed in the compartment;

a vacuum pipe having one end opening into the bag and an other end opening into the accumulation chamber; and suction means to generate vacuum in the vacuum pipe between the chamber and the bag compartment.

The vertical portion of the unit may also comprise:

a heavy duty disposal unit located preferably to one side of the water tank and operated by third power means; and a discharge pipe communicating with the disposal unit at one end and the accumulation chamber at its other end.

The method of operation of the invention is as follows:

1) The toilet, the disposal unit or both of them are actuated to cause all of the waste material, solid and liquid, to fall onto the filter screen, the liquid waste passing through the screen.

2) The filter disk, in its first, upper position begins to rotate at a given speed to distribute the waste matter evenly around the chamber and form this matter into granules.

3) The heating means with or without the heat distribution means is actuated until the matter is sufficiently dry, as detected by sensors.

4) Then, the filter disk is dropped to its second lower position, thereby opening access to the vacuum pipe.

5) Finally, the suction means is then actuated and the granular remains of the waste are sucked up the vacuum pipe into the bag.

When the disk is in its upper position, it is above the vacuum pipe opening in the chamber. Thus the solid and semi-solid waste does not pass into the vacuum pipe until it is dry and until the disk drops into its second position.

BRIEF DESCRIPTION OF THE DRAWINGS

The invention and its advantages will be better understood upon reading of the following non-restrictive description of a preferred embodiment thereof, given with reference to the accompanying drawings, in which.

DESCRIPTION OF A PREFERRED EMBODIMENT

Figure 1:
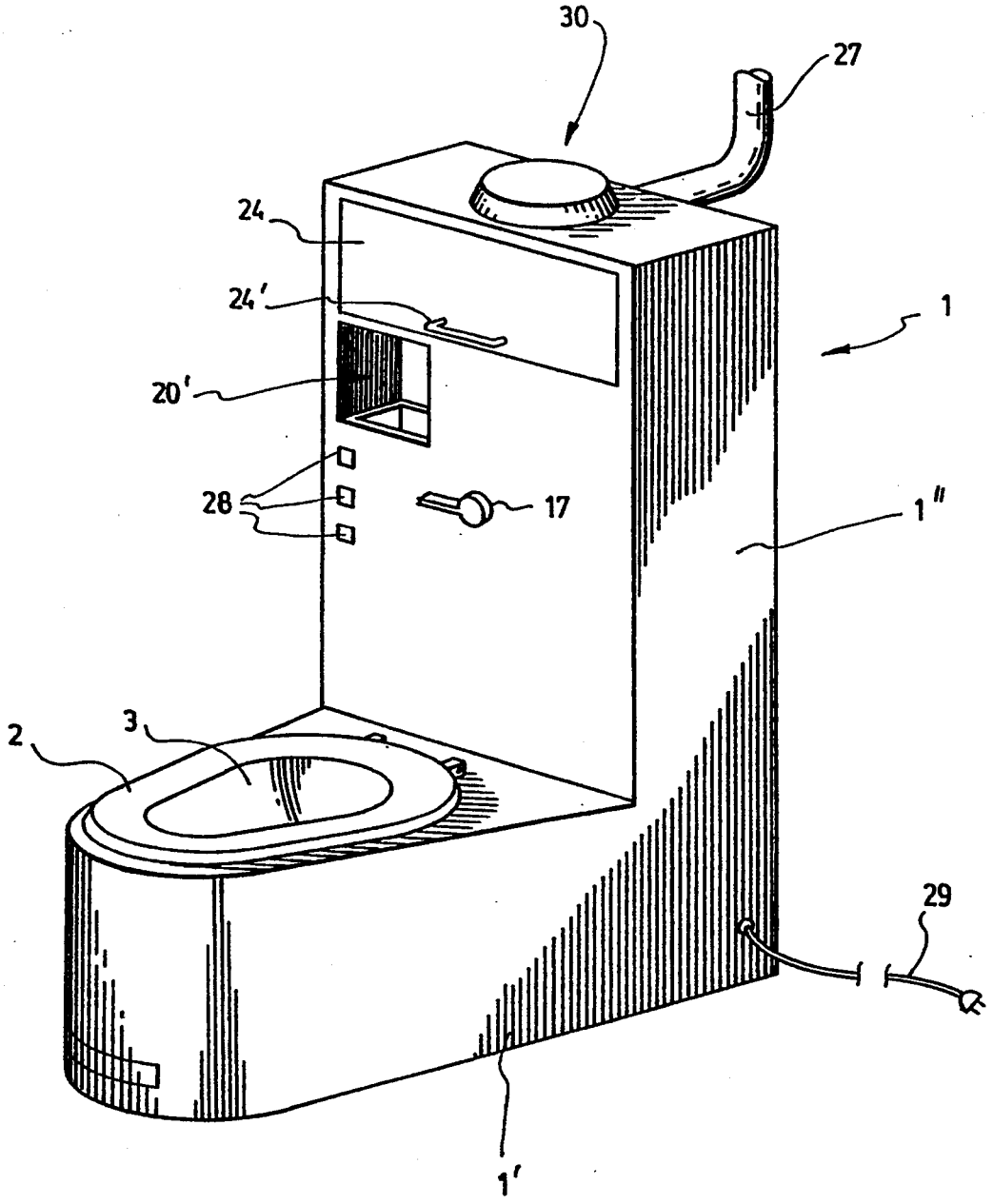
FIG. 1 is a perspective view of a modified flush toilet according to the invention.
Figure 3:
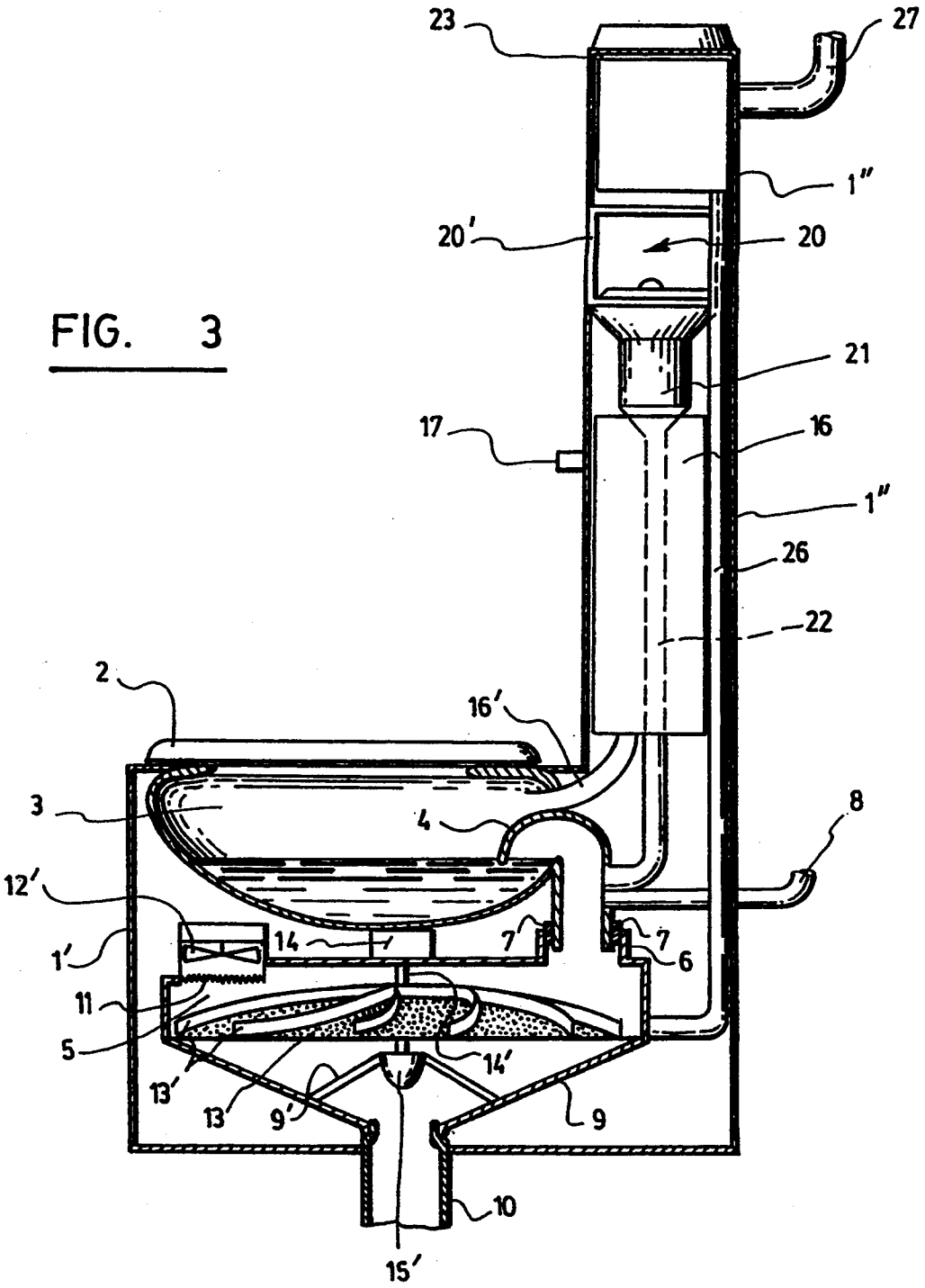
FIG. 3 is a lateral elevation view, also partially sectioned, of the embodiment of FIG. 1.

FIGS. 1 and 3 illustrate a preferred embodiment of the invention. In these figures, there is shown a modified flush toilet comprising a box-casing 1 having an L-shape profile. The latter has a frontwardly projecting portion 1' and an upright portion 1''.

Portion 1' will be described first. It comprises a standard toilet seat 2 disposed over a bowl 3 which contains water as shown. The rear of the bowl 3 is fitted with an elbow pipe 4 through which the contents of the bowl drains when the toilet is flushed. Located under the toilet bowl is an accumulation chamber 5. Such chamber has an entry pipe 6 which is attached to the pipe 4 by a connection means consisting of a rubber gasket 7. An opening is provided in the elbow pipe 4 which communicates with a vent pipe 8 which preferably but not necessarily opens to the exterior of the room in which the invention is installed.

Figure 4:
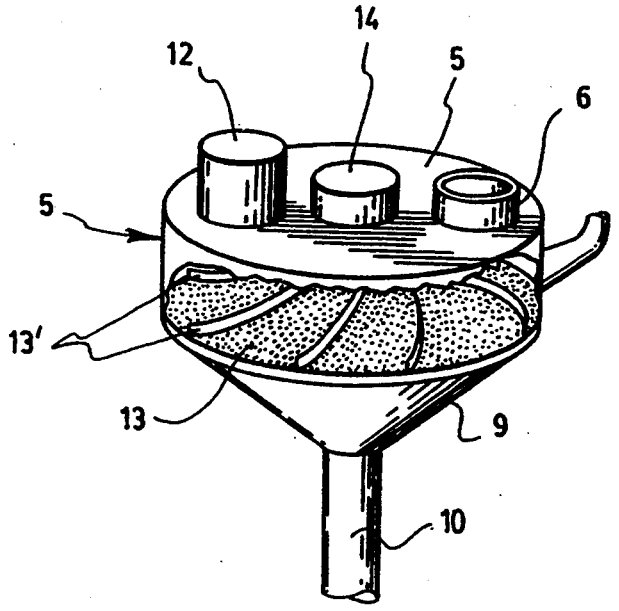
FIG. 4 is an isolated perspective view of the accumulation chamber.
Figure 5:
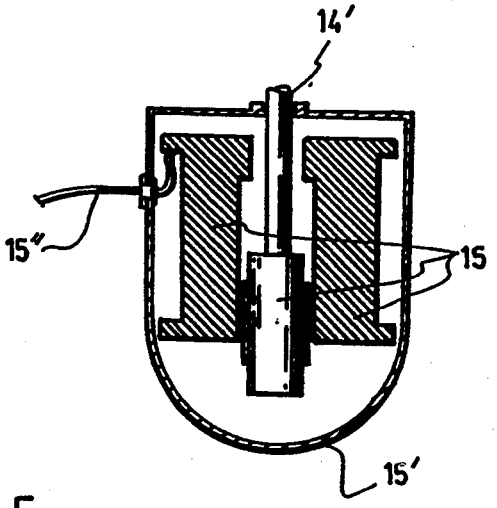
FIG. 5 is an elevation view of the second power means of the disk.

As clearly shown in FIGS. 3 and 4, the accumulation chamber 5 is in the shape of a funnel with an upper circular portion and a lower conical portion 9. The smaller lower end of the chamber 5 is secured to a drainpipe 10 as by welding. Disposed in the conical lower portion of the chamber 5 is an inverted cone member 9' which has an uppermost aperture and a surface provided with a plurality of perforations.

Figure 2:
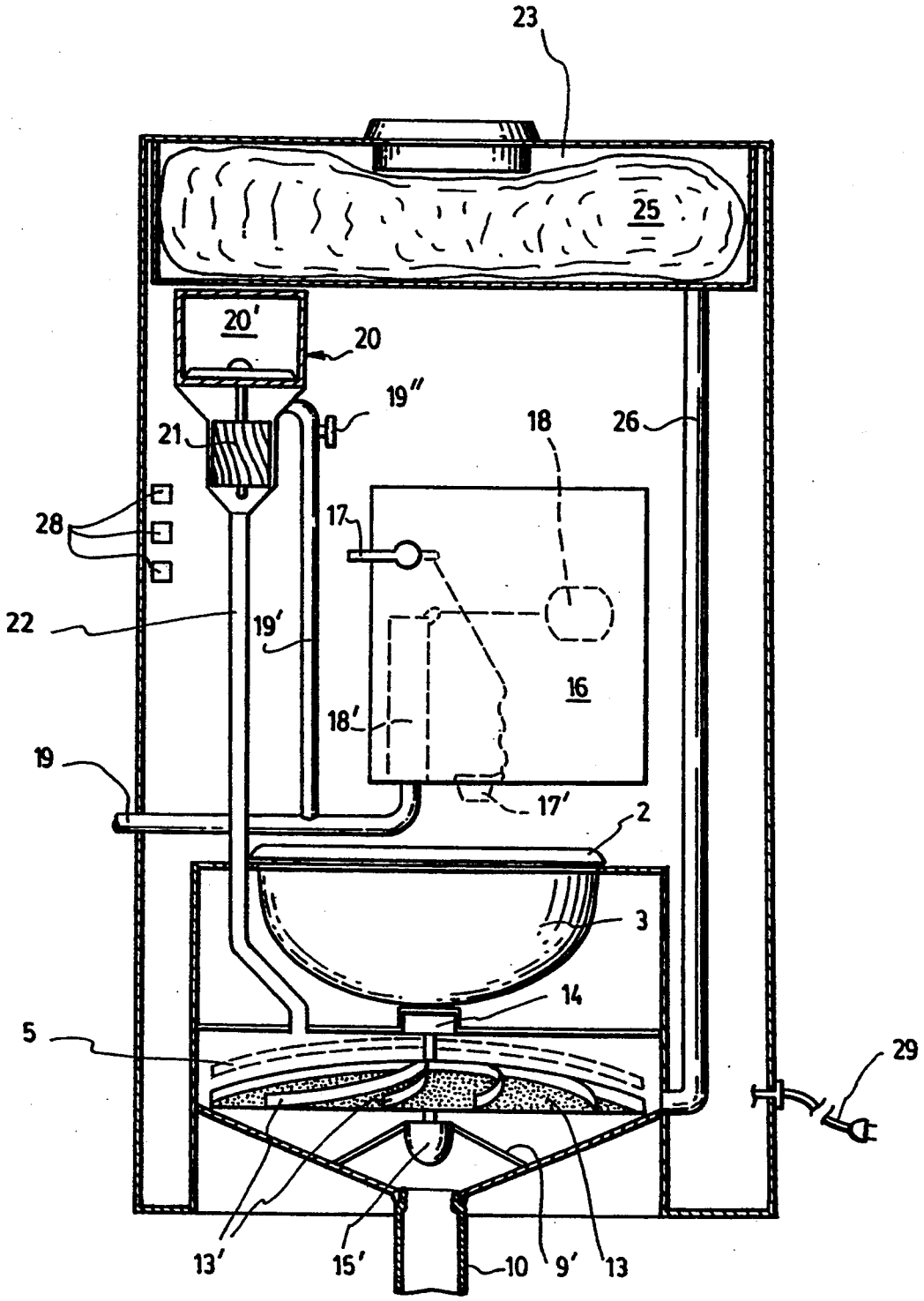
FIG. 2 is a front elevation view, partially in cross-section of the embodiment of FIG. 1.

The accumulation chamber 5 also contains the following elements:

a) a microscreen filter disk 13 rotatably mounted in the chamber and provided with distribution vanes 13';

b) first power means to rotate the disk, consisting of a small electric motor 14; and c) second power means to raise and lower the disk, consisting of an electromagnetic element assembly 15, adapted to bias the shaft 14' of the motor 14 in one of two vertical positions. The assembly 15 is contained within a rounded cap 15' which is disposed at the lower end of the shaft 14'. The cap 15' fits precisely into the aperture of the inverted cone 9' when the disk is in lower position as shown in FIG. 2.

The accumulation chamber 5 further contains:

d) a heating means 11 consisting of an electrical filament; and e) a heat distribution means consisting of an electric fan 12; and f) heat sensors (not shown).

Portion 1'' will now be described, having reference to FIGS. 2 and 3. As can be seen, this portion comprises a water tank 16 adapted to empty its contents into bowl 3 through a pipe 16'. The tank 16 has a standard float valve 18 connected to a mechanism 18'. The flush valve 17' is operated by a lever 17. The water tank 16 is adapted to be filled by water from a supply pipe 19 connected to a suitable source (not shown).

The portion 1'' also comprises a disposal unit 20 of the heavy duty type, like the one used in the draw of domestic sinks. The unit 20 is operated by third power means which may consist of a small electric motor 21, and is accessible by a rectangular opening 20', through which material to be ground up is introduced. The liquified contents of the unit 20 are directed through a discharge pipe 22 into accumulation chamber 5, as clearly shown in FIG. 2. The disposal unit 20 is also fed, as is known, by a branch of water supply pipe 19', the latter being provided with a control valve 19''.

Further provided in the upper portion 1'' is a compartment for the granular material accumulated in chamber 5. Such compartment 23 contains a bag 25. The compartment 23 has a front door 24 and a handle 24'. A vacuum pipe 26 communicates with both the accumulation chamber and the bag 25, as in a vacuum cleaner, and is powered by a suction means 30 seen in FIG. 1. The suction means may have an outlet pipe 27 opening to the exterior of the room.

The assembly is completed by a control panel 28 and a plug 29 connectable to an electrical outlet, all the power means being preferably electrical.

The method of operation of the invention has been described in the summary and need not be repeated here.

I claim:

1. A modified toilet adapted to be installed over the drainpipe of a standard flush toilet, said modified toilet having a block structure with a front portion and a vertical portion, wherein:

A) said front portion comprises:

a standard toilet bowl;

a seat therefor spaced slightly above the top surface of said front portion;

a waste accumulation chamber located under said toilet bowl;

an elbow pipe communicating with the toilet bowl and the accumulation chamber;

a filter disk rotatably mounted in said accumulation chamber;

first power means to rotate the disk;

second power means to move the disk from a first upper position to a second lower position; and heating means disposed in the accumulation chamber; and B) said vertical portion comprises:

a water tank connected to said bowl and also adapted to be connected to a water supply source;

a compartment accessible by a door;

a bag disposed in the compartment;

a vacuum pipe having one end communicating with said bag and another end with said accumulation chamber;

suction means to generate vacuum in said vacuum pipe between said chamber and said compartment; and means to control all the power means.

2. A modified toilet as defined in claim 1, wherein said vertical portion further comprises:

a disposal unit;

third power means to operate said disposal unit; and a discharge pipe having one end communicating with the disposal unit and another end with said accumulation chamber.

3. A modified toilet as defined in claim 2, wherein said filter disk is provided with a plurality of radially disposed curved distribution vanes.

4. A modified toilet as defined in claim 3, wherein said chamber is in the shape of a funnel having a conical lower portion provided with an interior inverted cone member having a plurality of perforations; and uppermost central aperture.

5. A modified toilet as defined in claim 4, wherein said first power means consists of an electric motor having a shaft connected to said filter disk.

6. A modified toilet as defined in claim 5, wherein said second power means consists of an electromagnetic assembly adapted to bias the shaft of said electric motor in one of two vertical positions.

7. A modified toilet as defined in claim 6, wherein said elbow pipe has a vent pipe communicating therewith.

8. A modified toilet as defined in claim 7, wherein there is provided a connection means between said elbow pipe and said accumulation chamber, consisting of a chamber entry pipe surrounding said elbow pipe, and a rubber gasket disposed between said entry pipe and said elbow pipe.

9. A modified toilet as defined in claim 8, wherein said suction means is provided with an outlet pipe.

10. A modified toilet as defined in claim 9, wherein said third power means consists of another electric motor connected to said disposal unit.

11. A modified toilet as defined in claim 10, wherein said heating means consists of an electrical filament.

12. A modified toilet as defined in claim 11, wherein said chamber is further provided with a heat distribution means.

13. A modified toilet as defined in claim 12, wherein said heat distribution means is an electric fan.

14. A method for treating toilet waste in a modified toilet including a toilet bowl; a water tank connected to the bowl; an accumulation chamber under said bowl communicating with the latter, said chamber being circular in shape at its upper portion and secured to a standard drain pipe at its lower portion; a filter disk rotatably mounted in said chamber; first power means to rotate said disk; second power means to selectively move the disk to one of two vertical positions; heating means for generating heat and heat distribution means for distributing said heat to said chamber; a bag located for distributing said heat to a compartment; a vacuum pipe having one end connected to said chamber and another end to said bag; and suction means to provide a vacuum in said pipe; said method comprising the following steps:

a) actuating the toilet after use, thereby causing the waste material, solid and liquid, to fall onto the filter screen, the liquid waste passing through the screen;

b) rotating the filter disk in the upper position at a given speed to distribute the waste evenly around the chamber;

c) actuating the heating means and the heat distribution means until the waste is sufficiently dry and forms granular remains;

d) dropping the filter disk into the second lower position thereby opening access to the vacuum pipe; and e) actuating the suction means to suck up the granular remains of the waste into the bag through the vacuum pipe, as the disk continues to rotate at a given speed.

* * * * *